US005178103A

United States Patent [19]

Simko

[11] Patent Number: 5,178,103

[45] Date of Patent: Jan. 12, 1993

[54] VARIABLE COMPRESSION RATIO PISTON

[75] Inventor: Aladar O. Simko, Dearborn Heights, Mich.

[73] Assignee: Ford Motor Company, Dearborn, Mich.

[21] Appl. No.: 362,151

[22] Filed: Dec. 23, 1991

[51] Int. Cl.[5] ..... F02D 15/02

[52] U.S. Cl. ..... 123/48 B; 123/78 B

[58] Field of Search ..... 123/78 B, 78 BA, 48 B, 123/48 R, 78 R, 78 E, 193 P

[56] References Cited

U.S. PATENT DOCUMENTS

| | | | |
|---|---|---|---|
| 3,405,697 | 10/1968 | Marchand | 123/78 B |
| 3,527,264 | 9/1970 | Bachle | 123/78 B |
| 4,031,868 | 6/1977 | Karaba et al. | 123/78 B |
| 4,864,975 | 9/1989 | Hasegawa | 123/78 BA |
| 4,864,977 | 9/1989 | Hasegawa | 123/78 BA |
| 4,934,347 | 6/1990 | Suga et al. | 123/78 B |

*Primary Examiner*—David A. Okonsky

*Attorney, Agent, or Firm*—Jerome R. Drouillard; Roger L. May

[57] ABSTRACT

A variable compression ratio device for an internal combustion engine includes a connecting rod having passages formed therein for communicating a hydraulic signal to the piston attached to the connecting rod, means for generating a hydraulic signal having a signal characteristic which is indicative of a desired compression ratio, and a variable compression height piston which is positionable in a plurality of compression heights, including fully retracted, fully extended, and at least one position therebetween, with the piston having an outer section slidably mounted on an inner section, and with the inner section being attached to the connecting rod, with the piston having means responsive to inertia and gas pressure forces and to the generated hydraulic signal for controlling the compression height.

13 Claims, 3 Drawing Sheets

VARIABLE COMPRESSION RATIO PISTON

BACKGROUND OF THE INVENTION

1. Field of the Invention

The present invention relates to an adjustable piston having variable compression height which may be changed in response to a command from an engine controller.

2. Disclosure Information

Variable compression ratio pistons have been the subject of many designs U.S. Pat. No. 3,403,662 to Blackburne, U.S. Pat. No. 3,418,982 to Waugaman, U.S. Pat. No. 3,450,112 to Bachle, U.S. Pat. No. 4,138,973 to Luria all disclose systems for variable compression ratio pistons in which the height of the piston is responsive to pressure within the combustion chamber Such pistons suffer from the deficiency that they are not controllable by signals other than the pressure within the combustion chamber.

U.S. Pat. No. 3,200,798 to Mansfield discloses a piston having a pump driven by an eccentric formed upon the small end of the connecting rod for the purpose of providing pressurized oil for changing the compression height of a piston. As before, the piston is not capable of responding to a control signal other than combustion chamber pressure.

U.S. Pat. No. 4,785,790 to Pfeffer et al. discloses a variable compression height piston having special valving which allows additional oil to flow into the upper control chamber of the piston so as to increase compression ratio while the engine is being started.

U.S. Pat. No. 4,979,427 to Pfeffer et al. discloses a thermally responsive variable compression ratio piston.

U.S. Pat. No. 4,469,055 to Caswell discloses a variable compression ratio piston having a remotely controlled pump and a sensor network which provides hydraulic Pressure through a flexible line to the piston. It is not believed that such a system would be durable in a modern high speed engine because of the need to accommodate the flexible duct between the pump and piston.

U.S. Pat. No. 4,809,650 to Arai et al. discloses a variable compression ratio piston which is responsive to a control pressure coommunicated by a channel formed within a connecting rod. The piston disclosed in the '650 patent is capable of operating at only two controlled positions—i.e., maximum compression height and minimum compression height. It is not possible to position the piston in intermediate compression heights.

It is an object of the present invention to provide a variable compression ratio piston which is positionable in a plurality of compression heights from a maximum to a minimum value.

It is an object of the present invention to provide a variable compression ratio piston which will allow adjustment of a piston's compression height to optimize engine operation not only for high speed high load operation but also for cold starting.

It is yet another object of the present invention to provide a variable compression height piston which may be controlled with either a hydraulic signal communicated through the normal oil passageways of an engine, or by means of an electronic device within the piston.

Other objects, features and advantages of the present invention will be apparent to the reader of this specification.

SUMMARY OF THE INVENTION

A variable compression ratio device for an internal combustion engine includes a connecting rod having passages formed therein for communicating a hydraulic signal to a piston attached to the connecting rod, and means for generating a hydraulic signal having a signal characteristic which is indicative of a desired compression ratio. According an aspect of the present invention, a variable compression ratio device also includes a variable compression height piston which is positionable in a plurality of compression heights, including fully retracted, fully extended, and at least one position therebetween. The piston has an outer section slidably mounted on an inner section, with the inner section being attached to the connecting rod, and with the piston further comprising means responsive to inertia and gas pressure forces and to the hydraulic signal for controlling the compression height. The means for generating a hydraulic signal may comprise means for controlling the pressures of lubricating oil provided to first and second passages within the connecting rod in response to at least one engine operating parameter. The means responsive to a hydraulic signal for controlling the compression height of the piston may comprise a control valve which is rotationally positionable by the hydraulic signal and which is translationally positionable by the piston's outer section.

A control valve comprising part of a system according to the present invention may be rotationally positioned by means of a rack-geared plunger which is responsive to a hydraulic signal. The control valve may comprise a generally cylindrical body having a metering helix formed on its cylindrical outer surface, with the control valve further comprising an upper passage extending axially from the upper end of the cylindrical body to a port formed on the surface of the cylinder below the helix, and a lower passage extending axially from the lower end of the cylindrical body to a port formed on the surface of the cylinder above the helix. The control valve is slidably housed within a ported bore extending through the inner section of the piston in a direction parallel to the axial motion of the piston, with both ends of a control valve extending from the bore and abutting the outer section of the piston, such that the control valve will move axially and translationally with the piston's outer section.

According to another aspect of the present invention, a means responsive to a hydraulic signal for controlling the compression height of a piston further comprises an upper chamber extending between the top of the inner section of the piston and the top of the outer section of the piston and a lower chamber extending between the bottom of the inner section of the piston and the bottom of the outer section of the piston, with the chambers being filled with engine lubricating oil flowing through said upper and lower passages in the control valve primarily in response to inertia and gas pressure forces acting on the outer piston section and according to the rotational position of the control valve.

According to another aspect of the present invention, a control valve may be positioned by an electrically driven motor housed within the piston's inner section.

DETAILED DESCRIPTION OF THE PREFERRED EMBODIMENTS

Figure 9:
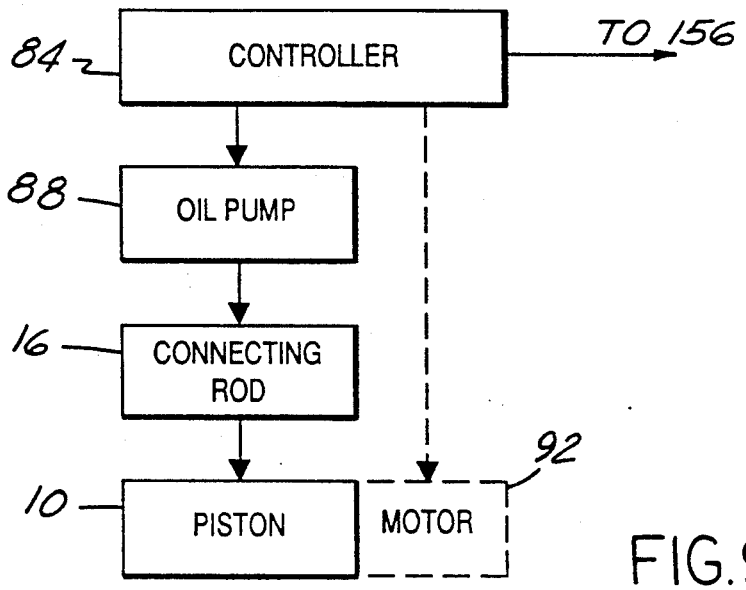
FIG. 9 is a block diagram showing two system variations according to the present invention.

As shown schematically in FIG. 9, a controller, 84, which is responsive to at least one engine operating parameter, which may comprise engine load, combustion chamber pressure, other parameters or combinations of parameters, controls output of an oil pump, 88, which supplies hydraulic fluid, which may comprise engine lubricating oil or some other type of fluid, to a connecting rod, 16, which in turn furnishes the fluid to a piston, 10. Alternatively, controller 84 may directly command a motor, 92, which comprises a part of piston 10 to perform the function of operating a control valve according to the present invention. Motor 92 may comprise either an electric motor such as a stepper or torque motor or some other type of motor.

Figure 2:
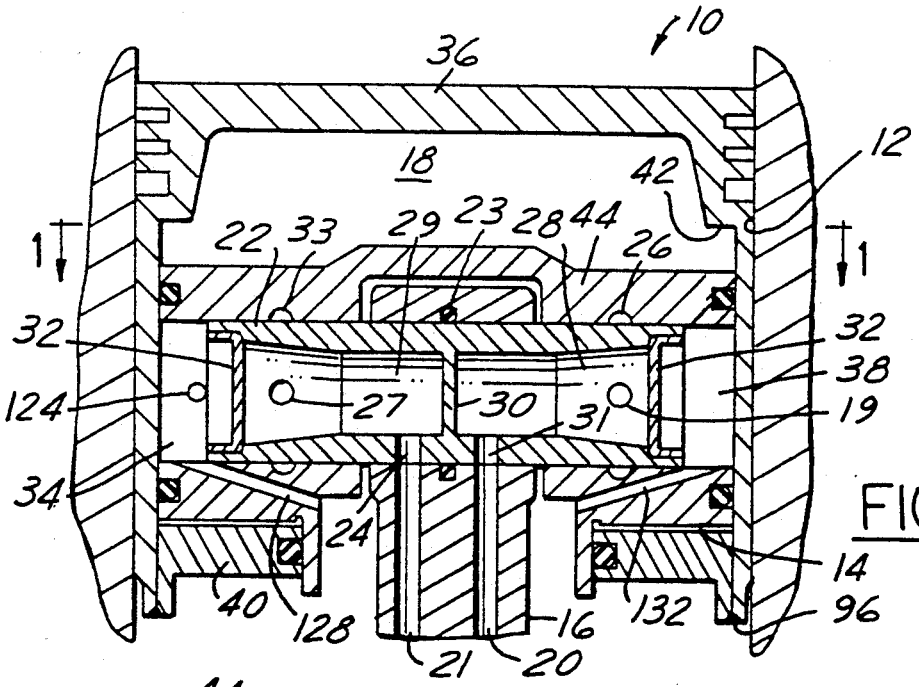
FIG. 2 is a sectional view of a piston according to the present invention, taken along the line 2—2 of FIG. 1.

Turning now to FIG. 2, a piston 10, reciprocably mounted with an engine cylinder, 12, is connected with the crankshaft of an engine (not shown) by means of connecting rod 16. Hydraulic fluid, in this case, engine lubricating oil, is provided to piston 10 via passages 20 and 21 formed in connecting rod 16. Passages 20 and 21 may be supplied with oil via the normal engine lubricating oil pump, with the pressure output of the pump being controlled by means of controller 84. Oil travelling up passage 20 from the large end of connecting rod 16 passes into interior cavity 28 of the piston's wrist pin, 22, via supply port 24. Oil leaves cavity 28 by means of one or more exit ports 19 and flows into supply groove 26 which is formed in the wrist pin bore. Note that the ends of cavity 28 are sealed by means of plugs 30 and 32 so all oil reaching the interior of wrist pin 22 must leave through exit port 18. Oil flowing through supply groove 26 eventually ends up either in upper cavity 18, which is defined as the cavity extending between the top of the inner section of the piston, 44, and the lower surface of the top of the outer section of the piston, 36, or in bore 56, which will be described in detail below. Note that oil within upper cavity 18 will prevent the piston from becoming fully retracted. Full retraction occurs when upper land, 42, of outer section 36 comes in contact with the upper surface of inner section 44.

When it is desired to increase the compression height of the piston, oil is moved into upper cavity 18 and released from lower cavity 14 causing outer section 36 to move upward relative to inner section 44 and wrist pin 22. It is noted in this regard that inner section 44 is allowed only to pivot on wrist pin 22 and does not move axially with respect to the wrist pin.

When it is desired to reduce the compression height of the piston, oil is admitted into lower cavity 14 and released from upper cavity 18; placing oil in the lower cavity will cause outer section 36 of the piston to move downwardly with respect to inner section 44 and wrist pin 22. This reduction in compression height of piston 10 will have the effect of reducing the compression ratio achieved by an engine using a piston and connecting rod arrangement according to the present invention.

Figure 3:
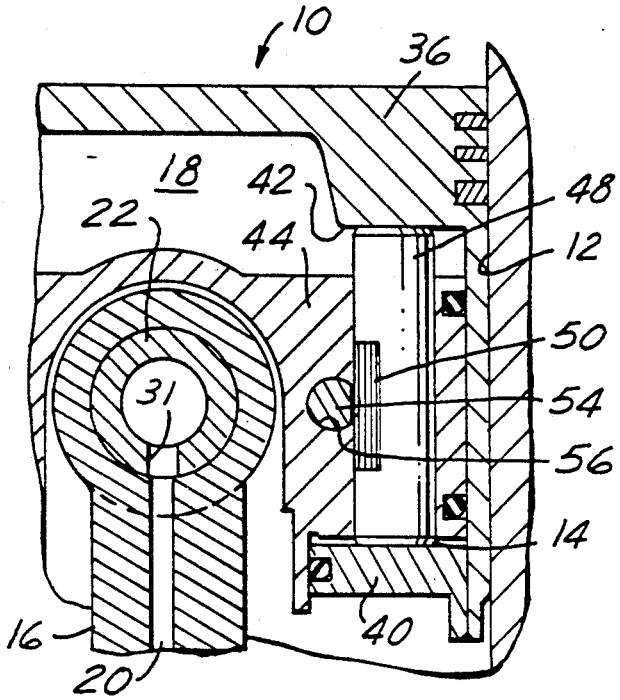
FIG. 3 is a partial section of the piston of FIGS. 1 and 2, taken along the line 3—3 of FIG. 1.

The compression height of a piston according to the present invention is determined, as noted above, by the relative volumes of oil trapped in upper cavity 18 and lower cavity 14. The relative volumes of oil trapped in these cavities is determined by the rotational position of control valve 48. As best seen from FIGS. 1 and 3, the rotational position of control valve 48 is determined by the axial location of rack-geared control plunger 54, which is housed in a bore formed in inner section 44 of piston 10. Oil entering supply groove 26 from the interior of wrist pin 22 flows to chamber 56 and displaces control plunger 54 against the biasing force of calibration spring 60 and the force of oil within chamber 25. Controlled oil pressure within chamber 25 arises from connecting rod passage 21 through supply port 31 to cavity 29 within wrist pin 22 and then through exit port 27 and into grooved channel 33. A seal, 23, prevents the oil within passages 20 and 21 from bleeding into the incorrect supply port 24 or 31, as the case may be. After entering grooved channel 33, oil moves to chamber 25 (see FIG. 1). Thus, it may be seen that the axial position of control plunger 54 depends upon the magnitude of the hydraulic forces resulting from the pressures within chambers 56 and 25 as well as upon the force exerted by control plunger spring 60.

As control plunger 54 is displaced axially, a series of rack teeth, 58, forming a gear rack on control plunger 54, interact with pinion teeth 50 (FIG. 3) formed on control valve 48, thereby rotating control valve 48 to a rotational position which corresponds to the difference between the pressures transmitted through passages 20 and 21 in connecting rod 16. It is the rotational position of control valve 48 which determines the compression height of the piston.

Figure 10:
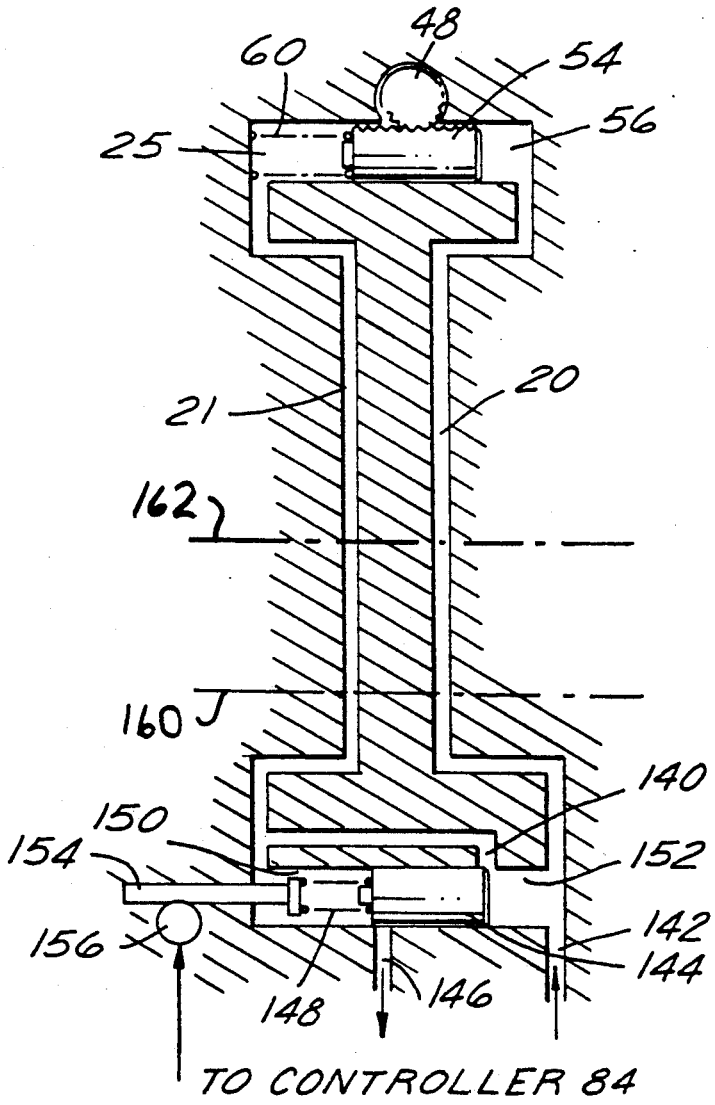
FIG. 10 is a schematic representation of a control plunger oil feed system according to one aspect of the present invention.

FIG. 10 is a schematic representation of a hydraulic signal generating means according to one aspect of the present invention. Beginning with the top of FIG. 10, control plunger 54 is shown as being positionable according to the control pressures contained within chambers 25 and 56. The control pressures are shown schematically as being transmitted along connecting rod passages 20 and 21. The crankshaft-connecting rod interface, 162, includes two 180° supply grooves in the connecting rod upper bearing insert, with each groove communicating with one of passages 20 and 21. Each of the two grooves in the upper bearing insert is fed a separately controllable pressure by separate holes bored into the connecting rod journal of the crankshaft. Each hole is fed by a passage drilled up from a different main bearing journal. The crankshaft holes feeding connecting rod 16 are located such that the 180° grooves are supplied with oil only when piston 10 is in the upper half of its stroke. Taken together, the pressures acting in passages 20 and 21 comprise a hydraulic signal pair.

The main bearing-crankshaft interface, 160, of FIG. 10 is intended to provide for continuous, unrestricted oil pressure to the crankshaft's connecting rod journals. This may be accomplished by feeding the oil passages drilled up from the main bearing journal to the connecting rod journal by means of 360° grooves formed in the main bearing insert. Alternatively, the main bearing inserts may be grooved so that the crankshaft oil passage receives oil only when the 180° supply grooves in the connecting rod upper bearing inserts are indexed with the supply holes in the crankshaft's connecting rod journals. Each of the passages 20 and 21 will then receive pressure whenever piston 10 is on the upper half of its stroke. Adjacent main bearing journals of the crankshaft may be provided with different oil pressures according to this invention and these pressures may be communicated with piston 10 via passages 20 and 21.

The pressure regulation system shown in the lower part of FIG. 10, which is part of oil pump 88 shown in FIG. 9, provides passage 20 with oil at a relatively constant high pressure, such as, for example, 60 psi. Oil enters the system shown in FIG. 10 through port 144 and flows without restriction through passage 20 into piston 10. Passage 21 is supplied with variable pressure in the range, for example, of 30 to 60 psi. As described above, control plunger 54 is positioned according to the difference in pressures supplied by passages 20 and 21. The pressure within passage 21 is controlled by controller 84, which operates spring load adjustor 156, by means of a stepper motor, or a hydraulic motor (not shown) or by some other similar device known to those skilled in the art and suggested by this disclosure. Spring load adjustor 156 biases spring plunger 154, which preloads spring 148. The force of spring 148 is exerted upon pressure regulator plunger 144. If the load upon spring 148 is increased by spring plunger 154 as a result of a command from controller 84, pressure regulator plunger 144 will move to the right, thereby opening drain passage 146. As a result, the pressure in chamber 150 and passage 21 will decrease and plunger 144 will move to the left to further restrict drain 146 and to assume an equilibrium position If the load upon spring 148 is reduced, plunger 144 moves to the left, thereby further opening port 140 and increasing the pressure in chamber 150 and passage 21, causing plunger 144 to move to the right to an equilibrium position.

Each position of spring plunger 154 is marked by a unique differential between the pressures within passages 20 and 21. In turn, these pressures relate to a unique position for control valve 48, and ultimately, to a unique compression height for piston 10. The novel system of the present invention, including dual passages 20 and 21 through connecting rod 16, compensates for inertia forces which would otherwise disrupt the control of compression height if only a single connecting rod passage were used. Without compensation, inertia forces acting on the oil within a single connecting rod passage would render the oil pressure within the passage a nullity during part of the piston's stroke, while greatly amplifying the pressure at other parts of the piston's stroke. Inertia forces act on the column of oil within the connecting rod such that the oil pressure is increased during the upper half of the piston's stroke and reduced during the lower half of the stroke. According to the present system, the inertia forces on each of the columns of oil within passages 20 and 21 will cancel each other during the upper half of the piston stroke because control plunger 54 responds to the differential pressure between passages 20 and 21. During the lower half of the piston stroke, the cutoff provided by the 180° grooves in crankshaft-connecting rod interface 162 will prevent oil from leaving passages 20 and 21.

The compression height of piston 10 results from the rotational position of control valve 48 as follows. Beginning with FIG. 3, note that control valve 48 extends between upper land 42 formed on outer section 36 and lower plate 40, which is joined immovably with outer section 36. Accordingly, control valve 48 moves translationally by reciprocating with outer section 36 as the outer section slides relative to inner section 44, so as to achieve a change in compression height.

Figure 4:
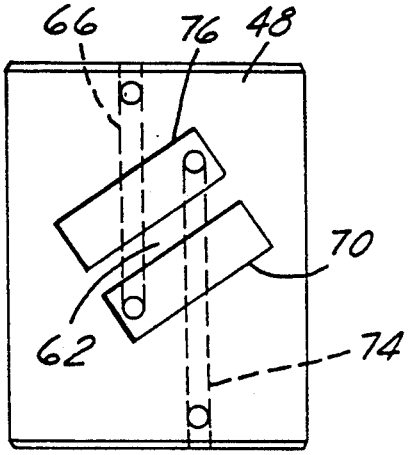
FIG. 4 illustrates the developed surface of a control valve, 18, embodied in a piston according to the present invention.

FIG. 4 illustrates the developed surface of control valve 48. Notice that control valve 48 has an upper passage 66, extending through control valve 48 to a lower port, 70, in the surface of the control valve (see also FIG. 5). Control valve 48 has a second lower axial passage, 74, which extends to an upper port 76. Ports 70 and 76 are separated by a metering helix, 62, which allows the rotational position of control valve 48 to determine the oil flow between upper cavity 18 and lower cavity 14.

Figure 1:
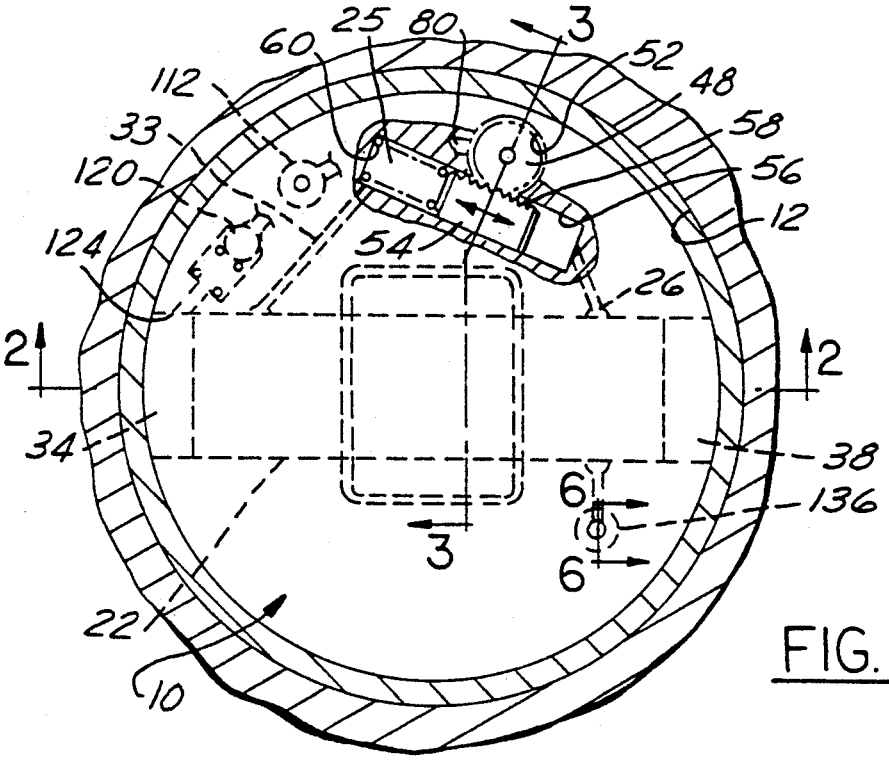
FIG. 1 is a plan view, partially broken away, of a piston having an adjustable compression ratio feature according to the present invention, taken along the line 1—1 of FIG. 2.
Figure 5:
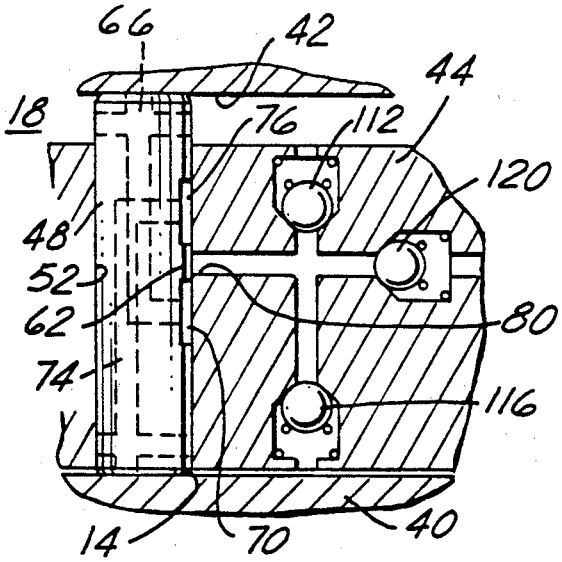
FIGS. 5 is a partially schematic representation of valving embodied in a piston according to the present invention.

Turning now to FIGS. 1 and 5, control valve 48 is housed within a bore, 52, formed within the piston's inner section, 44. An upward opening check valve, 112, allows oil to enter upper cavity 18, thereby increasing the compression height of piston 10. A downwardly opening check valve, 116, allows oil to enter lower cavity 14, thereby decreasing the compression height of piston 10. The oil is allowed to flow through various check valves due to the rotational position of control valve 40 as follows. The underlying concept of control includes the utilization of the axial forces which act on the piston cyclically in both directions. During the compression and power strokes of the engine, significant downward force is exerted on the piston because of the gas pressure within the combustion chamber. This force is counteracted by the oil in upper cavity 18. During the later part of the exhaust stroke and during most of the intake stroke, an upward force acts on the piston. This force is generally of a lesser magnitude than the previously described downwardly acting force. The upwardly acting force is supported and counteracted by the oil trapped in lower cavity 14.

The function of control valve 48 is to allow oil to flow into one of the upper or lower cavities until the required compression height is achieved, at which time valve 48 shuts off the oil flow automatically. This operation can be understood with reference to FIGS. 4 and 5. More specifically, when metering helix 62 is positioned so as to block the flow into metering passage, 80, oil cannot flow through either of check valves 112 or 116, or for that matter, check valve 120, and the piston will be hydraulically locked at a given compression height. If controller 84 signals oil pump 88 to increase the pressure in cavity 25 operating on control plunger 54, the control plunger will move to the right, causing control valve 48 to rotate counterclockwise as viewed from the top in FIG. 1. As a result, upper port 76, which is maintained in fluid contact with lower passage 74, will be connected with metering passage 80, and oil will be allowed to flow from lower cavity 14 through lower passage 74 and metering passage 80 and past check valve 112 into upper cavity 118. Check valve 112 prevents oil flow in the reverse direction. In response to the oil flow into upper cavity 118, the compression height of the piston will be increased until a point is reached at which metering helix 62 once again covers metering passage 80, at which time the compression height will be hydrostatically locked. If, on the other hand, the pressure signal is decreased by controller 84, decreased pressure acting upon control plunger 54 in cavity 25 will cause control valve 48 to rotate clockwise, as viewed from the top in FIG. 1, thereby placing lower port 70 in fluid contact with metering passage 80, and thereby allowing fluid to flow from upper cavity 18 through upper passage 66, through lower port 70 and then through check valve 116 into lower cavity 14. This will cause the compression height of the piston to be reduced until a point is reached at which metering helix 62 once again covers metering passage 80, at which time the compression height will again be hydrostatically locked.

Because the cross-sectional area of upper cavity 18 greatly exceeds that of lower cavity 14, check valve 120 allows surplus oil to be discharged through port 124 and into cavity 34 and through channel 128 into the crankcase of the engine, when the compression height of the piston is reduced (see FIGS. 1 and 2). On the other hand, when the compression height is increased, the volume of oil trapped in lower cavity 14 will always be insufficient to achieve the desired volume change in upper cavity 18. Because this is the case, additional oil will be admitted into upper cavity 18 by means of oil replenishment check valve 136 (see FIGS. 1 and 6). In addition to obviating problems resulting from oil sludging resulting from stagnation, this arrangement provides for a biasing oil pressure in the upward direction, which is advantageous because it accelerates the upward movement of the piston. Notwithstanding that seals may be used on the various moving parts of a system according to this invention, oil leakage may occur. This may cause oil to be lost from the upper and lower cavities. Any such loss will, whenever, automatically be replenished through oil replenishment check valve 136. Although valve 136 feeds only the upper cavity 18, this is not a problem because if oil is lost from lower cavity 14, the compression height will gradually increase. When this happens, control valve 48 will move upward relative to inner section 44, and lower port 70 will be connected to metering passage 80. As a result, oil will be caused by gas and inertia forces acting on outer piston section 36 to flow to lower cavity 14 and the compression height will be brought back to the desired value.

A system according to the present invention allows the compression height of the piston to be adjusted to any position in between the fully retracted and fully extended positions. Those skilled in the art will appreciate in view of this disclosure that merely by changing the differential pressure acting upon control plunger 54, a precise rotational position for control valve 48 may be selected and, as a consequence, the control valve will determine the precise positioning of outer section 36 with respect to inner section 44 and connecting rod 16. Accordingly, a system according to the present invention will produce an infinitely variable compression height so as to allow the effective compression ratio of the engine to be altered according to the operating needs of the engine.

Figure 7:
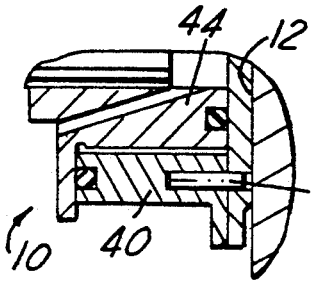
FIGS. 7 and 8 illustrate alternative methods for maintaining the lower plate, 40, of a piston according to the present invention, in contact with outer section 36.
Figure 8:
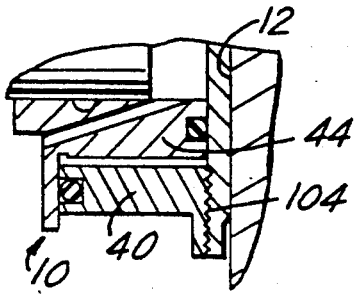
Figure 6:
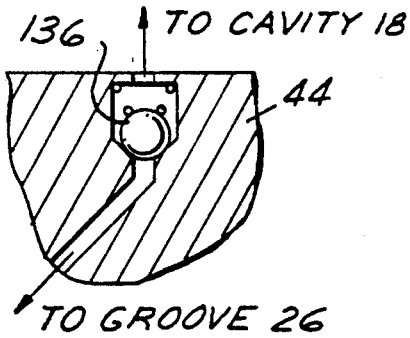
FIG. 6 is a sectional view of a valve comprising part of a system according to the present invention, taken along the line 6—6 of FIG. 1.

FIGS. 7 and 8 illustrate alternative means for securing lower plate 40 to outer section 36. As shown in FIG. 2, a first embodiment includes a weld, 96, imposed between the lower plate and outer section. FIG. 6 illustrates a radial pin, 100, which mechanically fastens the lower plate and outer section. FIG. 8 illustrates a threaded connection, 104, between the lower plate and outer section.

As shown schematically in FIG. 9, a motor, 92 may be substituted for control plunger 54 and the passages leading thereto. Motor 92 will position control valve 48 to the rotational location corresponding to the desired compression height. Such a motor could comprise an electrically driven unit such as a torque or stepper motor. Those skilled in the art will appreciate in view of this disclosure that controller 84 could communicate with motor 92 by means of high frequency electromagnetic emissions, or by more prosaic devices such as sliding electrical contacts or by yet other devices. In any case, the signal characteristic which is indicative of the desired compression height may be the amplitude or frequency of the transmitted signal, or some other appropriate characteristic. The use of a motor instead of a control plunger will obviate the need for two separate oil passages in connecting rod 16, because such a motor will operate essentially independently of the inertia forces which must be balanced in the case of a hydraulically actuated control valve. Accordingly, only a single oil passage will be required.

Although the invention has been described with reference to illustrated embodiments, it should be understood that numerous changes may be made within the spirit and scope of the inventive concepts described. Accordingly, it is intended that the invention not be limited to the illustrated embodiments, but that it have the full scope permitted by the language of the following claims.

I claim:

1. A variable compression ratio device for an internal combustion engine, comprising:

a connecting rod having passages formed therein for communicating a hydraulic signal to a piston attached to said connecting rod;

means for generating a hydraulic signal having a signal characteristic which is indicative of a desired compression height; and a variable compression height piston, which is positionable in a plurality of compression heights including fully retracted, fully extended and at least one position therebetween, with said piston having an outer section slidably mounted upon an inner section, with said inner section being attached to said connecting rod, and with said piston further comprising means responsive to inertia and gas pressure forces and to said hydraulic signal for controlling the compression height, wherein said means responsive to said hydraulic signal for controlling the compression height of said piston comprises a control valve which is rotationally positionable by said hydraulic signal and which is translationally positionable with respect to said inner piston section by said outer piston section.

2. A variable compression ratio device according to claim 1, wherein said means for generating a hydraulic signal comprises means for controlling the pressure of lubricating oil provided to said connecting rod in response to at least one engine operating parameter.

3. A variable compression ratio device according to claim 1, wherein said control valve is rotationally positioned by a rack-geared plunger which is responsive to said hydraulic signal.

4. A variable compression ratio device according to claim 1, wherein said control valve comprises a generally cylindrical body having a metering helix formed on its cylindrical outer surface.

5. A variable compression ratio device according to claim 4, wherein said control valve is slidably housed within a ported bore extending through the inner section of said piston in a direction parallel to the axial motion of the piston, with both ends of said control valve extending from said bore and abutting the outer section of the piston such that the control valve will move axially with said outer section.

6. A variable compression ratio device according to claim 4, wherein said control valve further comprises an upper passage extending axially from the upper end of said cylindrical body to a port formed on the surface of said cylinder below said helix, and a lower passage extending axially from the lower end of said cylindrical body to a port formed on the surface of said cylinder above said helix.

7. A variable compression ratio device according to claim 6, wherein said means responsive to said hydraulic signal for controlling the compression height of said piston further comprises an upper chamber extending between the top of the inner section of the piston and the and the top of the outer section of the piston and a lower chamber extending between the bottom of the inner section of the piston and the bottom of the outer section of the piston, with said chambers being filled with engine lubricating oil flowing through said first and second passages in said control valve primarily upon the urging of inertia and gas forces acting on the piston and according to the rotational position of said control valve.

8. A variable compression ratio device for an internal combustion engine, comprising:

a connecting rod having lubricating oil passages formed therein for communicating a hydraulic signal to a piston attached to said connecting rod;

means for generating a hydraulic signal having a signal characteristic which is indicative of a desired compression ratio; and a variable compression height piston which is responsive not only to hydraulic force, but also to inertial and gas forces, with said piston being positionable in a plurality of compression heights including fully retracted, fully extended and at least one position therebetween, with said piston having an outer section slidably mounted upon an inner section, with said inner section being attached to said connecting rod, and with said piston further comprising means responsive to said hydraulic signal for controlling the compression height, with said means comprising:

a control valve which is housed within said inner section and which is rotationally positionable by a rack-geared plunger which is positioned according to the hydraulic signal, with said control valve comprising a generally cylindrical body having a metering helix formed on its cylindrical outer surface and with said control valve being slidably housed within a ported bore extending through the inner section of said piston in a direction parallel to the axial motion of the piston, with both ends of said control valve extending from said bore and abutting the outer section of the piston such that the control valve will move axially with said outer section, and with the control valve having an upper passage extending axially from the upper end of said cylindrical body to a port formed on the surface of said cylinder below said helix, and a lower passage extending axially from the lower end of said cylindrical body to a port formed on the surface of said cylinder above said helix; and an upper chamber extending between the top of the inner section of the piston and the top of the outer section of the piston and a second chamber extending between the bottom of the inner section of the piston and the bottom of the outer section of the piston, with said chambers being filled with lubricating oil from said lubricating oil passage according to the rotational position of said control valve.

9. A variable compression ratio device for an internal combustion engine, comprising:

a connecting rod having a lubricating oil passage formed therein for supplying oil to a piston attached to said connecting rod;

means for generating a signal having a characteristic which is indicative of a desired compression ratio; and a variable compression height piston, which is positionable in a plurality of compression heights including fully retracted, fully extended and at least one position therebetween, with said piston having an outer section slidably mounted upon an inner section, with said inner section being attached to said connecting rod, and with said piston further comprising means responsive to inertia and gas pressure forces and to said signal for controlling the compression height, with said means comprising:

a control valve which is housed within said inner section and which is rotationally positionable according to the signal, with said control valve comprising a generally cylindrical body having a metering helix formed on its cylindrical outer surface and with said control valve being slidably housed within a ported bore extending through the inner section of said piston in a direction parallel to the axial motion of the piston, with both ends of said control valve extending from said bore and abutting the outer section of the piston such that the control valve will move axially with said outer section, and with the control valve having an upper passage extending axially from the upper end of said cylindrical body to a port formed on the surface of said cylinder below said helix, and a lower passage extending axially from the lower end of said cylindrical body to a port formed on the surface of said cylinder above said helix; and an upper chamber extending between the top of the inner section of the piston and the and the top of the outer section of the piston and a second chamber extending between the bottom of the inner section of the piston and the bottom of the outer section of the piston, with said chambers being filled with lubricating oil from said lubricating oil passage according to the rotational position of said control valve.

10. A variable compression ratio device according to claim 9, wherein said control valve is positioned by a motor housed within said inner section.

11. A variable compression ratio device according to claim 10, wherein said motor comprises an electrically driven unit.

12. A variable compression ratio device according to claim 10, wherein said motor comprises a hydraulically driven unit.

13. A variable compression ratio device for an internal combustion engine, comprising:

a connecting rod having first and second lubricating oil passages formed therein for communicating a hydraulic signal to a piston attached to said connecting rod;

means for generating a hydraulic signal having a signal characteristic which is indicative of a desired compression ratio, with said means comprising a controller for governing the lubricating oil pressures supplied to said first and second passages in said connecting rod; and a variable compression height piston, which is positionable in a plurality of compression heights including fully retracted, fully extended and at least one position therebetween, with said piston having an outer section slidably mounted upon an inner section, with said inner section being attached to said connecting rod, and with said piston further comprising means responsive to inertia and gas pressure forces and to said hydraulic signal for controlling the compression height, with said means comprising:

a control valve which is housed within said inner section and which is rotationally positionable by a rack-geared plunger which is positioned according to the pressures supplied to said first and second passages, with said control valve comprising a generally cylindrical body having a metering helix formed on its cylindrical outer surface and with said control valve being slidably housed within a ported bore extending through the inner section of said piston in a direction parallel to the axial motion of the piston, with both ends of said control valve extending from said bore and abutting the outer section of the piston such that the control valve will move axially with said outer section, and with the control valve having an upper passage extending axially from the upper end of said cylindrical body to a port formed on the surface of said cylinder below said helix, and a lower passage extending axially from the lower end of said cylindrical body to a port formed on the surface of said cylinder above said helix; and an upper chamber extending between the top of the inner section of the piston and the and the top of the outer section of the piston and a second chamber extending between the bottom of the inner section of the piston and the bottom of the outer section of the piston, with said chambers being filled with lubricating oil from said lubricating oil passage according to the rotational position of said control valve.

* * * * *